US011415388B2

(12) United States Patent
Su

(10) Patent No.: US 11,415,388 B2
(45) Date of Patent: Aug. 16, 2022

(54) EASILY LOCKABLE AND UNLOCKABLE HANDGUN HOLSTER

(71) Applicant: Wei Su, Shenzhen (CN)

(72) Inventor: Wei Su, Shenzhen (CN)

( * ) Notice: Subject to any disclaimer, the term of this patent is extended or adjusted under 35 U.S.C. 154(b) by 0 days.

(21) Appl. No.: 17/330,455

(22) Filed: May 26, 2021

(65) Prior Publication Data

US 2021/0278171 A1 Sep. 9, 2021

(51) Int. Cl.
*F41C 33/02* (2006.01)

(52) U.S. Cl.
CPC ..... *F41C 33/0263* (2013.01); *F41C 33/0236* (2013.01)

(58) Field of Classification Search
CPC ..... F41C 33/0263; F41C 33/0272; F41C 33/0236; F41C 33/0245; F41C 33/02
See application file for complete search history.

(56) References Cited

U.S. PATENT DOCUMENTS 5,944,239 A * 8/1999 Rogers ..... F41C 33/0209 224/193
6,385,890 B1 * 5/2002 Amadini ..... F41A 17/02 42/70.07
7,562,797 B2 * 7/2009 Senn ..... F41C 33/0263 224/198
9,664,480 B2 * 5/2017 Faifer ..... F41C 33/0227
2014/0048573 A1 * 2/2014 Pellegrini ..... F41C 33/0227 224/243
2020/0408488 A1 * 12/2020 Pellegrini ..... F41C 33/0263

* cited by examiner

*Primary Examiner* — Corey N Skurdal

(57) ABSTRACT

The present invention relates to the field of handgun holster technologies, and in particular, to an easily lockable and unlockable handgun holster. When the handgun holster needs to be unlocked, it is only necessary to press a button with a finger to complete unlocking of a handgun. When the handgun holster needs to be locked, it is only necessary to insert an end portion of the handgun into the handgun holster through an opening to complete locking of the handgun. The handgun holster of the present invention has a simple structure and can be unlocked through the button. When the handgun is placed in the handgun holster, locking is automatically implemented, so that unlocking and locking are convenient and fast.

8 Claims, 7 Drawing Sheets

EASILY LOCKABLE AND UNLOCKABLE HANDGUN HOLSTER

TECHNICAL HELD

The present invention relates to the field of handgun holster technologies, and in particular, to an easily lockable and unlockable handgun holster.

BACKGROUND

Handgun holsters are essential devices of law enforcement officials such as military servicemen and policemen and armed officers in China, and are used to carry and store handguns. According to state regulations, when performing duties, law enforcement officials and armed officers need to guarantee safe storage of handguns. For conventional handgun holsters, guns are prone to fall out, and there are other various disadvantages: in one aspect, when a handgun is placed, a trigger at the body of the handgun is in an open state, and the handgun is prone to accidental discharge, leading to unnecessary casualties; in another aspect, in order to pull out the gun, for a conventional handgun holster, a seal needs to be opened before the handgun can be withdrawn, and it takes a relatively long time, making it difficult to rapidly enter a battle state in emergencies.

SUMMARY

To resolve the foregoing problem, the present invention provides an easily lockable and unlockable handgun holster.

To achieve the foregoing objective, the technical solution adopted in the present invention is as follows: An easily lockable and unlockable handgun holster includes a case, a button, a buckle, a first spring, and a second spring, wherein an accommodating cavity is provided on a side of the case; the button, the buckle, the first spring, and the second spring are disposed in the accommodating cavity; one end of the button further penetrates to the outside of the accommodating cavity, the button is rotatably fixed on the case; one end of the first spring is connected to the button, the other end is connected to the surface of the case; a slot hole is provided in the case, the buckle is rotatably fixed in the slot hole; one end of the second spring is connected to the buckle, the other end is connected to the case; an end portion of the button is located on a side of the buckle, the end portion is in elastic contact with the buckle; at this time, the first spring is in a released state, the second spring is in a compressed state, and when the first spring is compressed, the end portion of the button leaves the buckle, and the second spring is in a released state.

Further, the case includes a case body and a case cover, the case cover is fixed to a side of a surface of the case body, the accommodating cavity is formed between the case cover and the case body; the button includes a button portion, a rotating portion, and a stop portion; the button portion is connected to an end of the rotating portion, the stop portion is connected to a side of an end portion of the rotating portion; the rotating portion is provided with a rotating hole, a protruding cylinder is provided on the surface of the case body or the case cover, the rotating portion is sleeved on the cylinder through the rotating hole, and the stop portion is capable of being in contact with the buckle.

Further, a groove is further provided in the surface of the case body, a clamping post is provided on a surface of the rotating portion, one end of the first spring is clamped in the groove, the other end is sleeved on the clamping post on the surface of the rotating portion, and the other end of the second spring is connected to the case cover.

Further, a groove is further provided in the surface of the case body, a clamping post is provided on a surface of the rotating portion, one end of the first spring is clamped in the groove, the other end is sleeved on the clamping post on the surface of the rotating portion, and the other end of the second spring is connected to the surface of the case body.

Further, a groove is further provided in the surface of the case body, one end of the first spring is clamped in the groove, the other end is connected to the inside of the rotating portion, and the other end of the second spring is connected to the case cover.

Further, a fixing post is further provided on the surface of the case body, a clamping post is provided on a surface of the rotating portion, one end of the first spring is sleeved in the fixing post, the other end is sleeved on the clamping post on the surface of the rotating portion, and the other end of the second spring is connected to the case cover.

Further, a groove is further provided on a surface of the case cover, one end of the first spring is clamped in the groove, the other end is connected to the inside of the rotating portion, and the other end of the second spring is connected to the case cover.

Further, a cavity for accommodating an end portion of a handgun is provided inside the case body, a side of the case body is provided with an opening for the end portion of the handgun to enter the cavity, and the case cover and the case body are detachably fixed by a screw.

Further, a through hole is provided in the middle of the buckle, a rotating shaft penetrates the through hole, two ends of the rotating shaft are respectively rotatably fixed to the inside the slot hole, respectively, an upper left surface of the buckle is connected to the second spring, an upper right surface of the buckle is in contact with the button, and a clamping slot for clamping a trigger guard of a handgun is provided on a lower surface of the buckle.

A first clamped post is provided on a left side surface of the buckle, a second clamped post is provided on an inner surface of the case cover, and two ends of the second spring are respectively sleeved on the first clamped post and the second clamped post.

The beneficial effects of the present invention are as follows: When the easily lockable and unlockable handgun holster of the present invention needs to be unlocked, it is only necessary to press the button with a finger to enable the button to leave the buckle, and the buckle is elastically ejected due to the second spring to complete unlocking of the handgun. When the handgun holster needs to be locked, it is only necessary to insert an end portion of the handgun into the handgun holster through an opening, the trigger guard of the handgun presses the buckle, the second spring is compressed, the clamping slot of the buckle locks the trigger guard of the handgun, the button returns under the elastic effect of the first spring, and the button stops the buckle, to complete locking of the handgun. The handgun holster of the present invention has a simple structure and can be unlocked through the button. When the handgun is placed in the handgun holster, locking is automatically implemented, so that unlocking and locking are convenient and fast.

Figure 1:
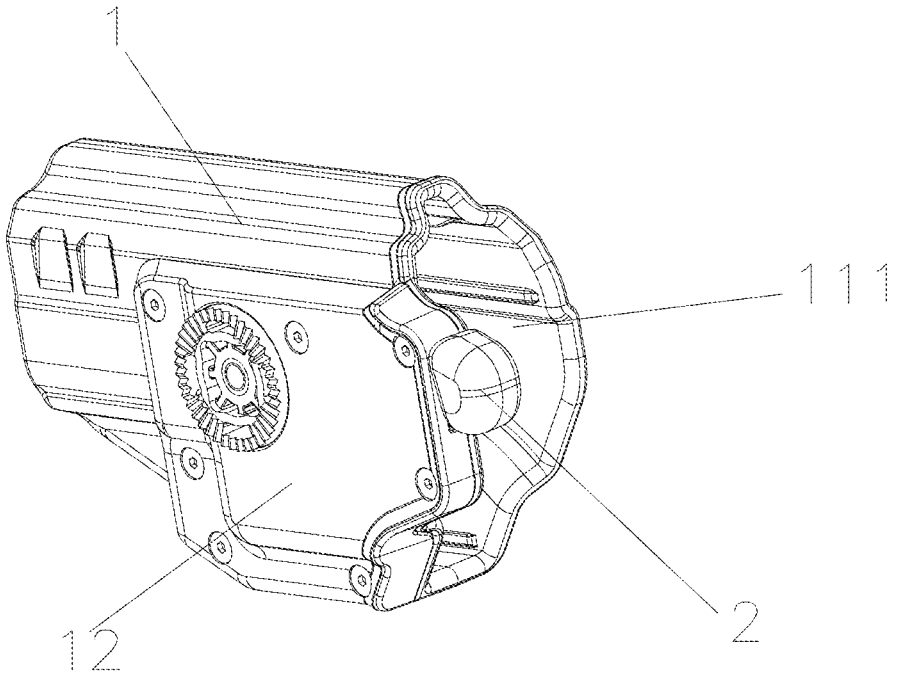
FIG. 1 is a three-dimensional schematic structural diagram of an embodiment.

Reference numerals: 1. case; 11. case body; 111. cavity; 112. slot hole; 113. groove; 114. fixing post; 12. case cover; 2. button; 21. button portion; 22. rotating portion; 221. clamping post; 23. stop portion; 3. buckle; 31. clamping slot; 4. first spring; 5. second spring; 6. handgun; and 61. trigger guard.

DETAILED DESCRIPTION

The present invention is further described below in detail by using specific implementations with reference to the accompanying drawings. This application may be implemented in various manners, and is not limited to the implementations described in the embodiments. The following specific implementations are provided for clearer and more thorough understanding of the disclosed content of this application. The words such as "up", "down", "left", and "right" that indicate orientations are only used for the positions of the structures in corresponding accompanying drawings.

Referring to FIG. 1 to FIG. 13, the present invention relates to an easily lockable and unlockable handgun holster, including a case 1, a button 2, a buckle 3, a first spring 4, and a second spring 5. An accommodating cavity is provided on a side of the case 1. The button 2, the buckle 3, the first spring 4, and the second spring 5 are disposed in the accommodating cavity. One end of the button 2 further penetrates to the outside of the accommodating cavity. The button 2 is rotatably fixed on the case 1. One end of the first spring 4 is connected to the button 2, and the other end is connected to a surface of the case 1. A slot hole 112 is provided in the case 1. The buckle 3 is rotatably fixed in the slot hole 112. One end of the second spring 5 is connected to the buckle 3, and the other end is connected to the case 1. An end portion of the button 2 is located on a side of the buckle 3. The end portion is in elastic contact with the buckle 3. At this time, the first spring 4 is in a released state, and the second spring 5 is in a compressed state. When the first spring 4 is compressed, the end portion of the button 2 leaves the buckle 3, and the second spring 5 is in a released state. The case 1 includes a case body 11 and a case cover 12. The case cover 12 and a side of a surface of the case body 11 are fixed. The accommodating cavity is formed between the case cover 12 and the case body 11. The button 2 includes a button portion 21, a rotating portion 22, and a stop portion 23. The button portion 21 is connected to an end of the rotating portion 22. The stop portion 23 is connected to a side of an end portion of the rotating portion 22. The rotating portion 22 is provided with a rotating hole. A protruding cylinder is provided on the surface of the case body 11 or the case cover 12. The rotating portion 22 is sleeved on the cylinder through the rotating hole. The stop portion 23 may be in contact with the buckle 3. In addition, a cavity 111 for accommodating an end portion of a handgun is provided inside the case body 11. A side of the case body is provided with an opening for the end portion of the handgun to enter the cavity 111. The case cover 12 and the case body 11 are detachably fixed by a screw.

It needs to be further noted that the positions and connection manners of the first spring 4 and the second spring 5 and the buckle 3, the case body 11, and the case cover 12 have the following preferred five implementations.

Embodiment One

Referring to FIG. 1 to FIG. 7 in this embodiment, a groove 113 is provided in the surface of the case body 11. A clamping post 221 is provided on a surface of the rotating portion 22. One end of the first spring 4 is clamped in the groove 113, and the other end is sleeved on the clamping post 221 on the surface of the rotating portion 22. The other end of the second spring 5 is connected to the case cover 12. A through hole is provided in the middle of the buckle 3. A rotating shaft penetrates the through hole. Two ends of the rotating shaft are respectively rotatably fixed inside the slot hole 112. An upper left surface of the buckle 3 is connected to the second spring 5. An upper right surface of the buckle 3 is in contact with the button 2. A clamping slot 31 for clamping a trigger guard 61 of a handgun 6 is provided on a lower surface of the buckle 3. In addition, a first clamped post is provided on a left side surface of the buckle 3. A second clamped post is provided on an inner surface of the case cover 12. Two ends of the second spring 5 are respectively sleeved on the first clamped post and the second clamped post.

Embodiment Two

Figure 2:
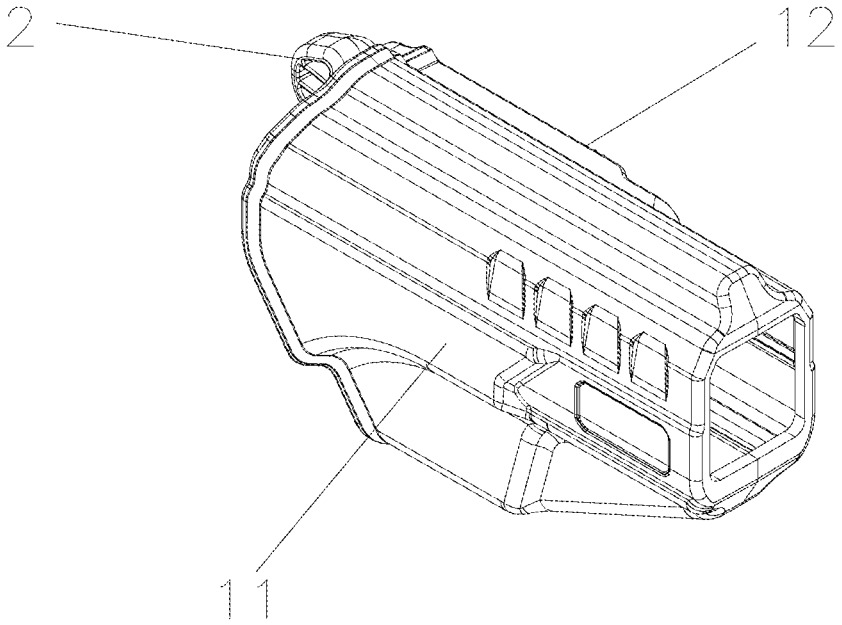
FIG. 2 is another three-dimensional schematic structural diagram of an embodiment.
Figure 3:
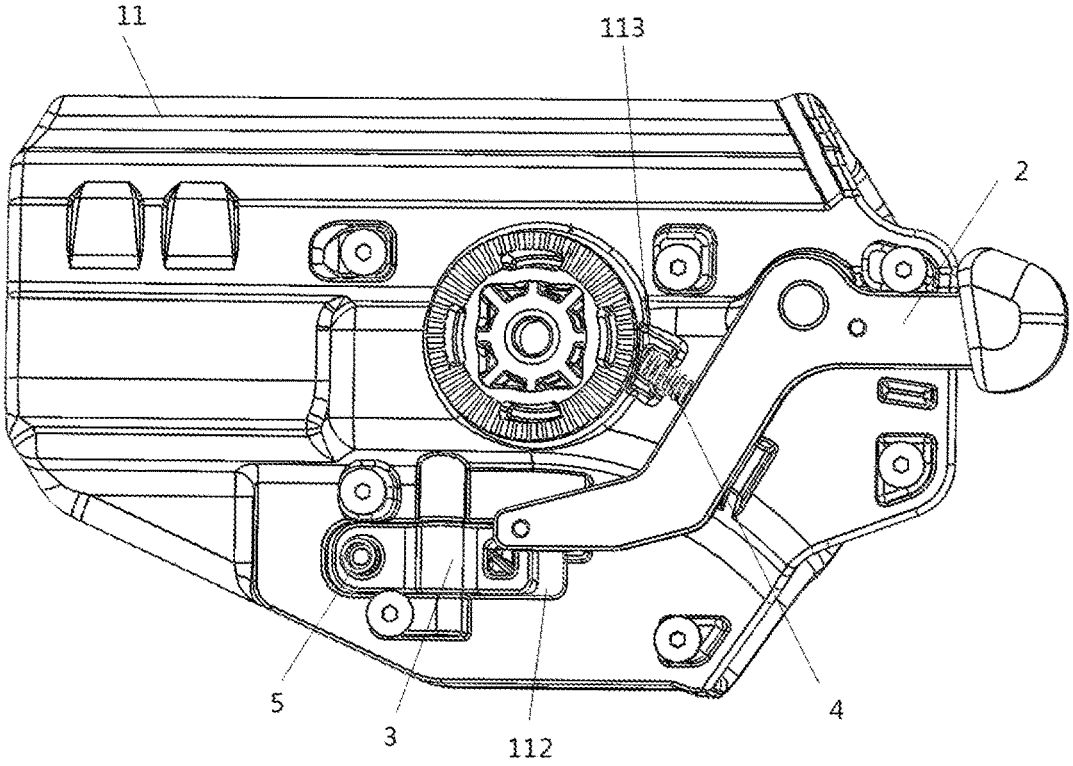
FIG. 3 is an internal schematic structural diagram when a buckle is locked in embodiment one.
Figure 4:
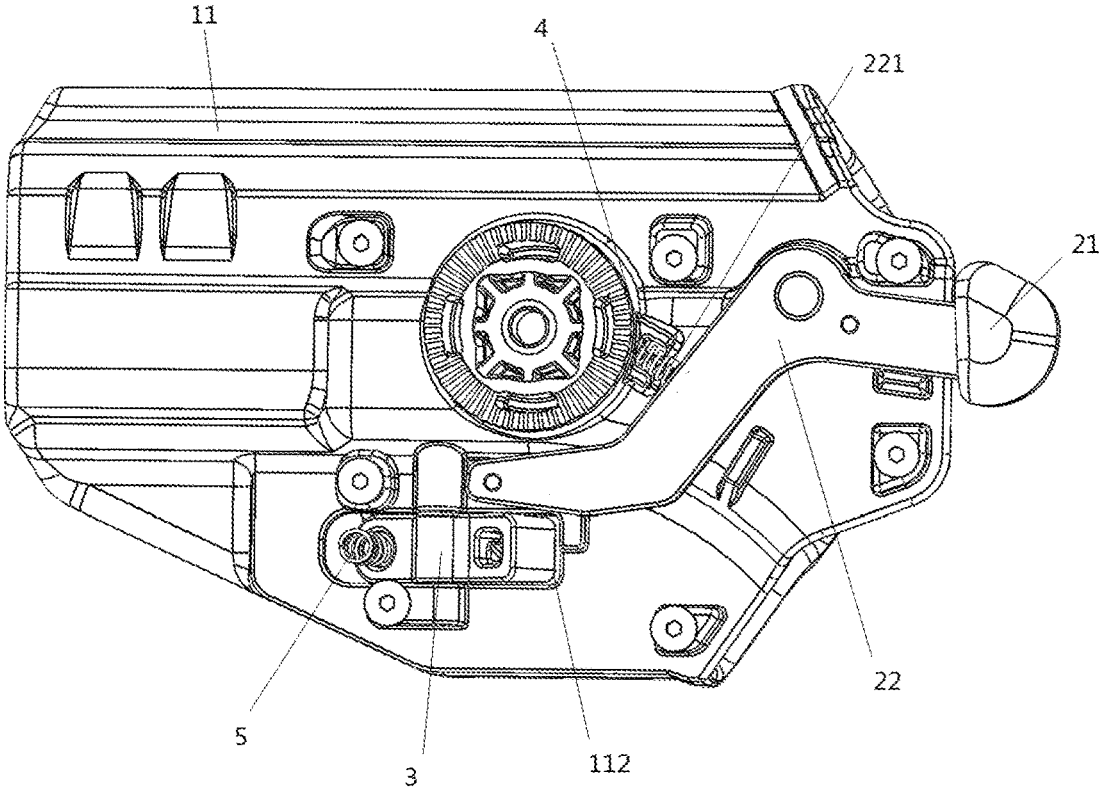
FIG. 4 is an internal schematic structural diagram when the buckle is unlocked in embodiment one.
Figure 5:
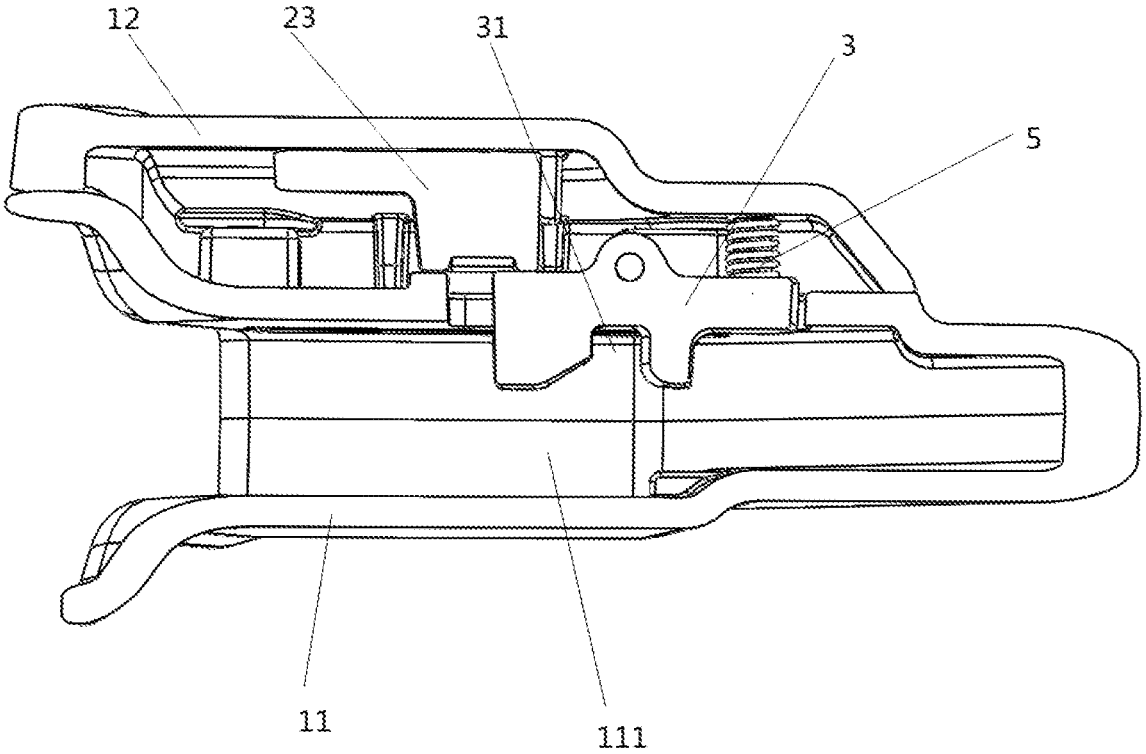
FIG. 5 is a sectional view when the buckle is locked in embodiment one.
Figure 6:
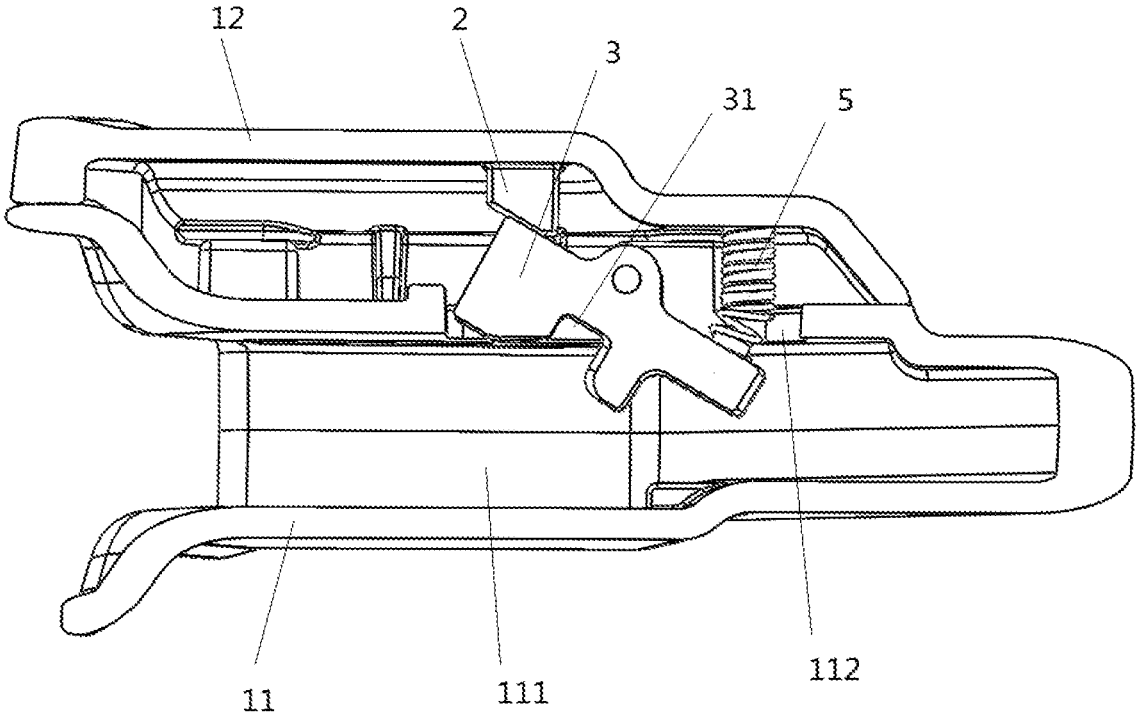
FIG. 6 is a sectional view when the buckle is unlocked in embodiment one.
Figure 7:
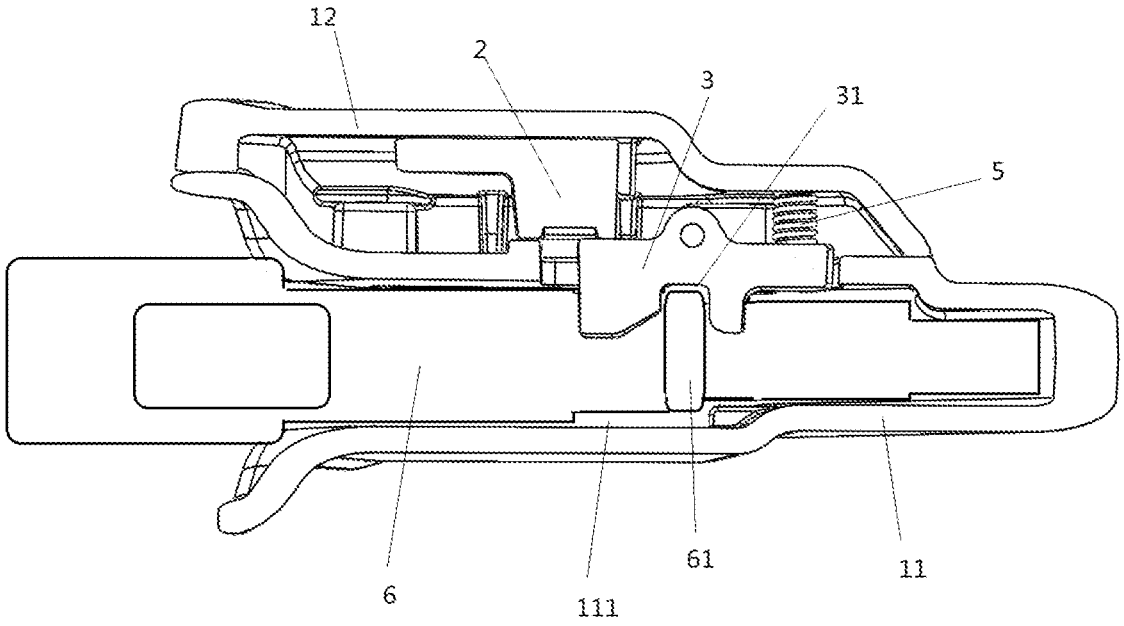
FIG. 7 is a sectional view when a handgun is locked in embodiment one.
Figure 8:
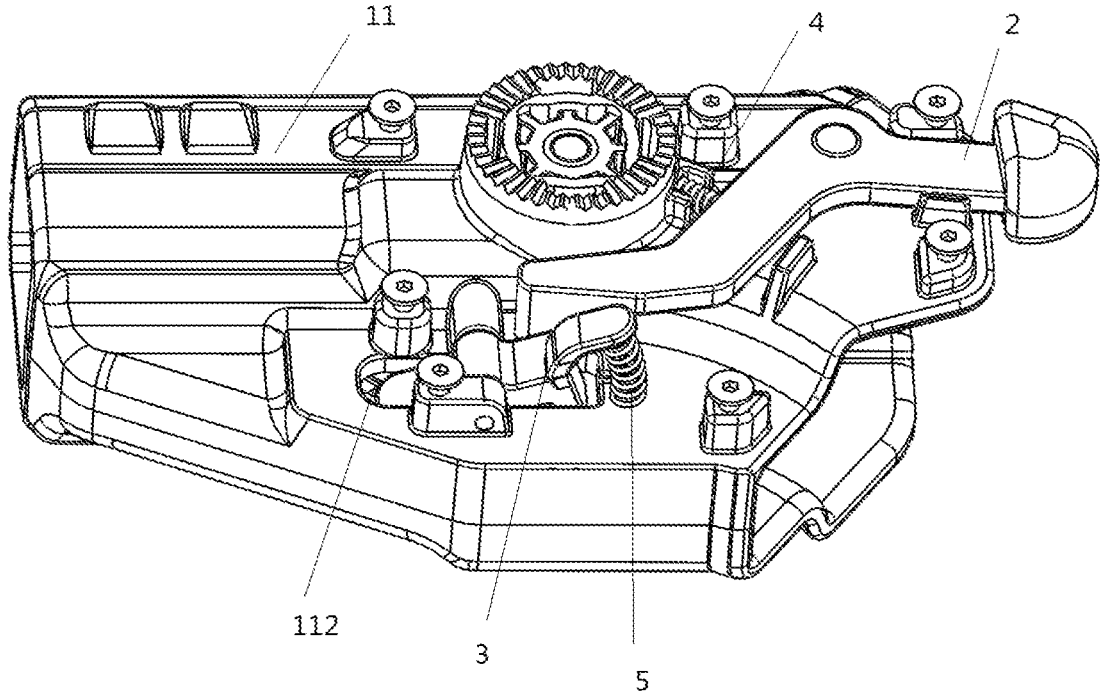
FIG. 8 is an internal schematic structural diagram of a case body in embodiment two.
Figure 9:
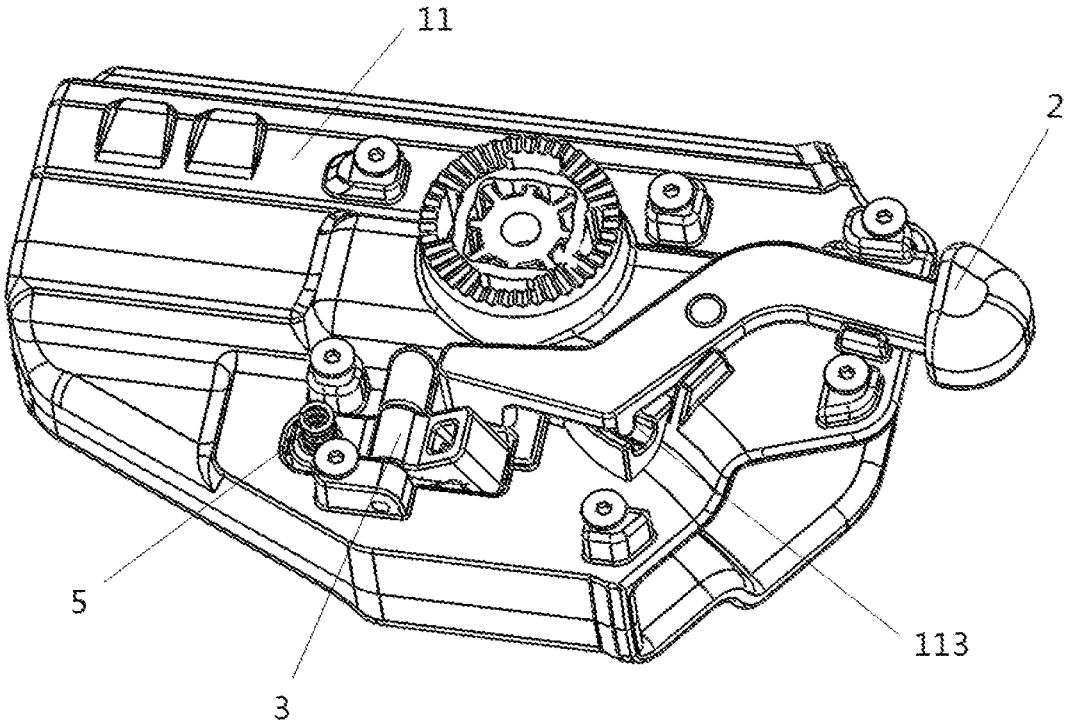
FIG. 9 is an internal schematic structural diagram of a case body in embodiment three.
Figure 10:
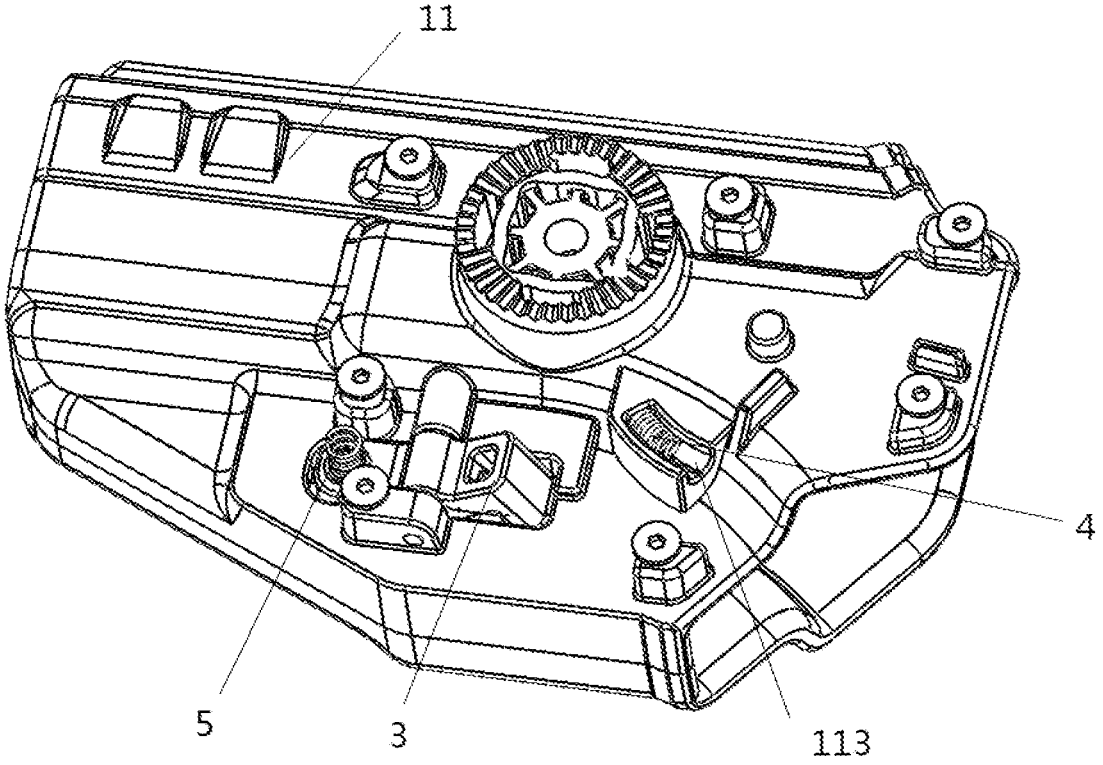
FIG. 10 is another internal schematic structural diagram of the case body in embodiment three.

Referring to FIG. 1, FIG. 2, and FIG. 8, in this embodiment, a groove 113 is further provided in the surface of the case body 11. A clamping post 221 is provided on a surface of the rotating portion 22. One end of the first spring 4 is clamped in the groove 113, and the other end is sleeved on the clamping post 221 on the surface of the rotating portion 22. The other end of the second spring 5 is connected to the surface of the case body 11. A through hole is provided in the middle of the buckle 3. A rotating shaft penetrates the through hole. Two ends of the rotating shaft are respectively rotatably fixed inside the slot hole 112. An upper right surface of the buckle 3 is in contact with the button 2. A protruding plate is provided on the right side of the buckle 3. A lower side surface of the protruding plate is connected to the second spring 5. A clamping slot 31 for clamping a trigger guard 61 of a handgun 6 is provided on a lower surface of the buckle 3. In addition, a first clamped post is provided on a lower right surface of the buckle 3. A second clamped post is provided on the surface of the case body 11. Two ends of the second spring 5 are respectively sleeved on the first clamped post and the second clamped post.

Embodiment Three

Referring to FIG. 1, FIG. 2, FIG. 9, and FIG. 10, in this embodiment, a groove 113 is further provided in the surface of the case body 11. One end of the first spring 4 is clamped in the groove 113, and the other end is connected to the inside of the rotating portion 22. The other end of the second spring 5 is connected to the case cover 12. A through hole is provided in the middle of the buckle 3. A rotating shaft penetrates the through hole. Two ends of the rotating shaft are respectively rotatably fixed inside the slot hole 112. An upper left surface of the buckle 3 is connected to the second spring 5. An upper right surface of the buckle 3 is in contact with the button 2. A clamping slot 31 for clamping a trigger guard 61 of a handgun 6 is provided on a lower surface of the buckle 3. In addition, a first clamped post is provided on a left side surface of the buckle 3. A second clamped post is provided on an inner surface of the case cover 12. Two ends of the second spring 5 are respectively sleeved on the first clamped post and the second clamped post.

Embodiment Four

Figure 11:
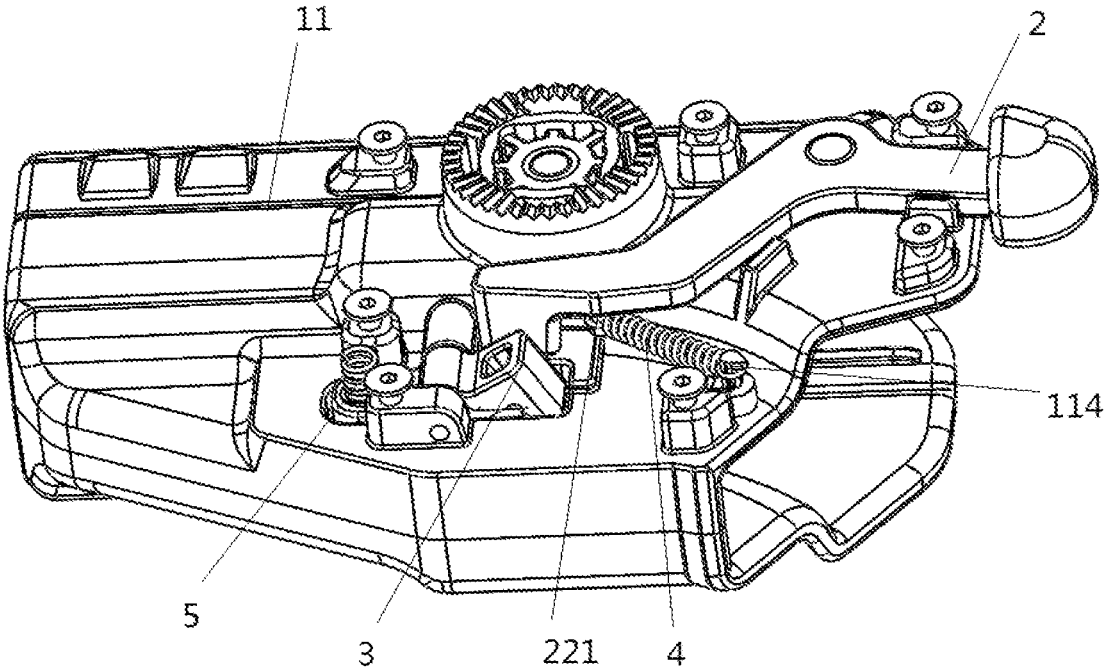
FIG. 11 is an internal schematic structural diagram of a case body in embodiment four.
Figure 12:
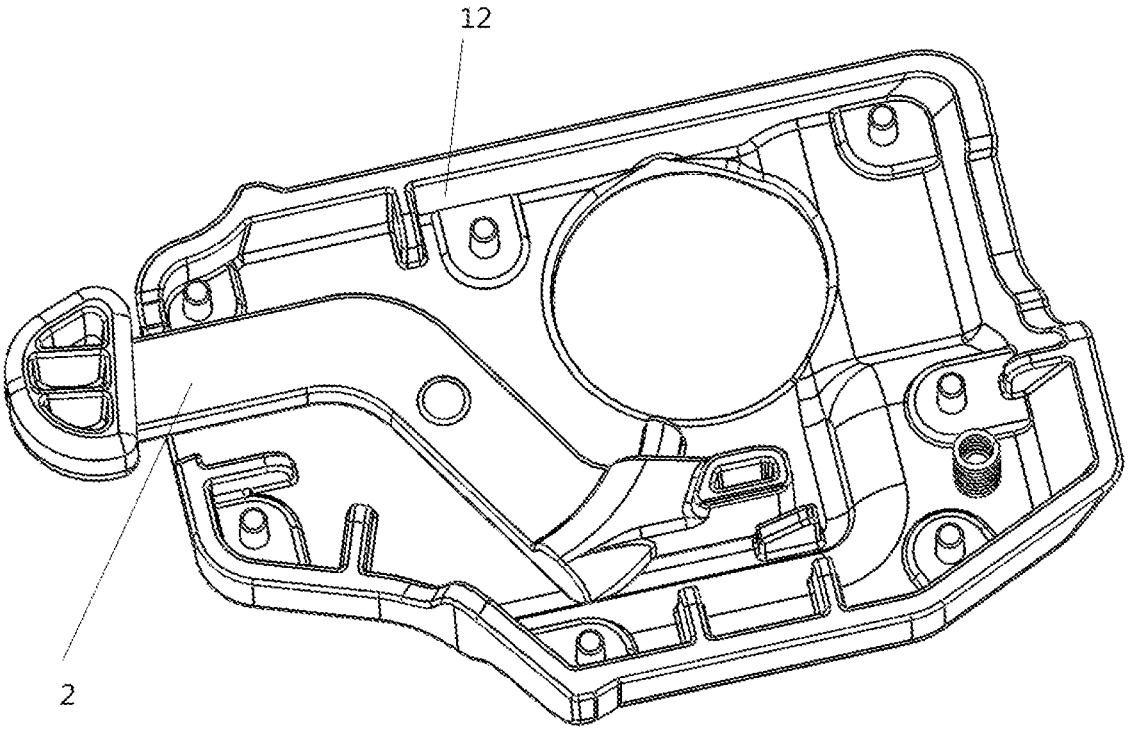
FIG. 12 is an internal schematic structural diagram of a case cover in embodiment five.
Figure 13:
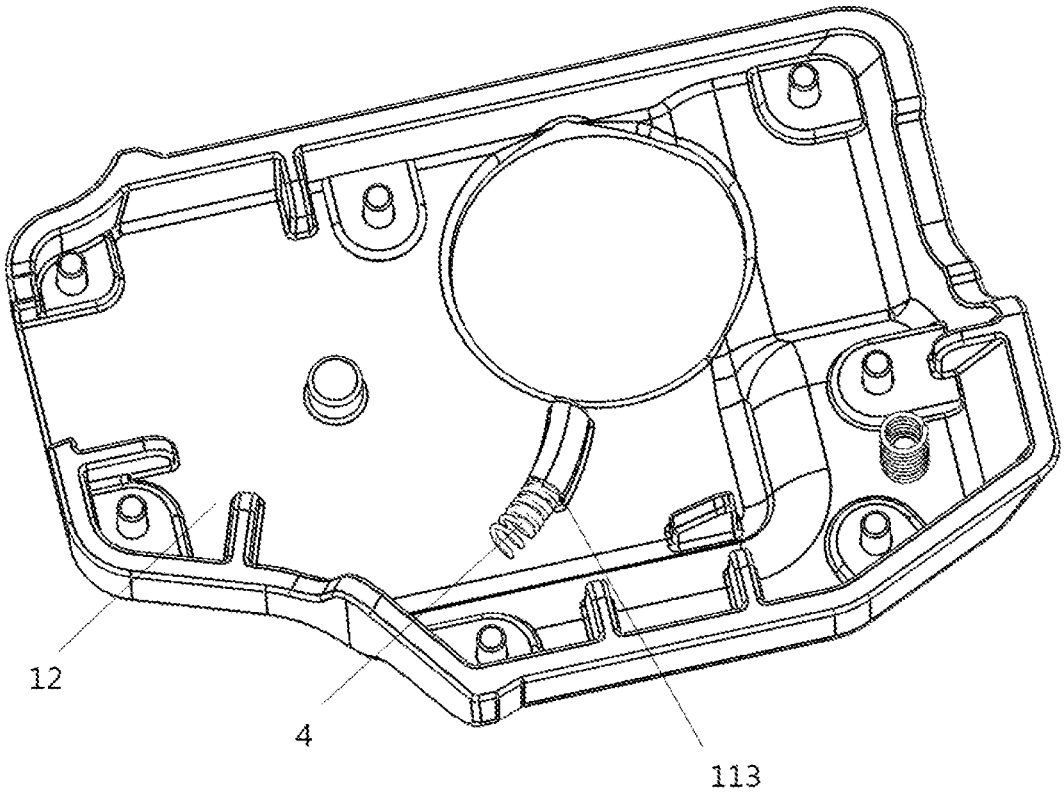
FIG. 13 is another internal schematic structural diagram of the case cover in embodiment five.

Referring to FIG. 1, FIG. 2, and FIG. 11, in this embodiment, a fixing post 114 is further provided on the surface of the case body 11. A clamping post 221 is provided on a surface of the rotating portion 22. One end of the first spring 4 is sleeved in the fixing post 114, and the other end is sleeved on the clamping post 221 on the surface of the rotating portion 22. The other end of the second spring 5 is connected to the case cover 12. A through hole is provided in the middle of the buckle 3. A rotating shaft penetrates the through hole. Two ends of the rotating shaft are respectively rotatably fixed inside the slot hole 112. An upper left surface of the buckle 3 is connected to the second spring 5. An upper right surface of the buckle 3 is in contact with the button 2. A clamping slot 31 for damping a trigger guard 61 of a handgun 6 is provided on a lower surface of the buckle 3. In addition, a first clamped post is provided on a left side surface of the buckle 3. A second clamped post is provided on an inner surface of the case cover 12. Two ends of the second spring 5 are respectively sleeved on the first clamped post and the second clamped post.

Embodiment Five

Referring to FIG. 1, FIG. 2, FIG. 12, and FIG. 13, in this embodiment, a groove 113 is further provided on the surface of the case cover 12. One end of the first spring 4 is clamped in the groove 113, and the other end is connected to the inside of the rotating portion 22. The other end of the second spring 5 is connected to the case cover 12. A through hole is provided in the middle of the buckle 3. A rotating shaft penetrates the through hole. Two ends of the rotating shall are respectively rotatably fixed inside the slot hole 112. An upper left surface of the buckle 3 is connected to the second spring 5. An upper right surface of the buckle 3 is in contact with the button 2. A clamping slot 31 for clamping a trigger guard 61 of a handgun 6 is provided on a lower surface of the buckle 3. In addition, a first clamped post is provided on a left side surface of the buckle 3. A second clamped post is provided on an inner surface of the case cover 12. Two ends of the second spring 5 are respectively sleeved on the first clamped post and the second clamped post.

Compared with the prior art, the handgun holster in these embodiments has a simple structure and can be unlocked through the button 2. When the handgun is placed in the handgun holster, locking is automatically implemented, so that unlocking and locking are convenient and fast. During use of the handgun holsters in Embodiment I to Embodiment V, in a natural state, the second spring 5 is in a released state. At this time, the buckle 3 tilts toward a side, provided with an opening, of the case 1, and a side of the buckle 3 stops the stop portion 23 of the button 2, to enable the first spring 4 to be in a compressed state. When the handgun is inserted into the cavity 111 of the case 1 through an opening, the trigger guard 61 of the handgun 6 presses the buckle 3, the buckle 3 rotates, and the second spring 5 is compressed. Finally, the clamping slot 31 of the buckle 3 locks the trigger guard 61 of the handgun 6, and a side surface of the buckle 3 no longer stops the button 2. Therefore, the button 2 returns under the elastic effect of the first spring 4. the stop portion 23 of the button 2 stops the buckle 3, to complete locking of the handgun.

It needs to be further noted that unless otherwise expressly specified and defined, terms such as "connect" and "fix" should be understood in a broad sense. For a person of ordinary skill in the art, specific meanings of the terms in the present invention should be understood according to specific conditions.

The foregoing implementations are merely descriptions of preferred implementations of the present invention and are not used to limit the scope of the present invention. Various variations and improvements made by a person of ordinary skill in the art to the technical solutions of the present invention without departing from the design spirit of the present invention shall fall within the protection scope determined by the claims of the present invention.

What is claimed is:

1. An easily lockable and unlockable handgun holster, comprising a case, a button, a buckle, a first spring, and a second spring, wherein an accommodating cavity is provided on a side of the case; the button, the buckle, the first spring, and the second spring are disposed in the accommodating cavity; one end of the button further penetrates outside the accommodating cavity, the button is rotatably fixed on the case; one end of the first spring is connected to the button, the other end is connected to a surface of the case; a slot hole is provided in the case, the buckle is rotatably fixed in the slot hole; one end of the second spring is connected to the buckle, the other end is connected to the case; an end portion of the button is located on a side of the buckle, the end portion is in contact with the buckle by an elastic force of the first spring, wherein the first spring is in a less-compressed state; the second spring is in a more-compressed state; and when the first spring is in a more-compressed state, the end portion of the button leaves the buckle, and the second spring is in a less-compressed state, wherein the case comprises a case body and a case cover, the case cover is fixed to a side of a surface of the case body, the accommodating cavity is formed between the case cover and the case body; the button comprises a button portion, a rotating portion, and a stop portion; the button portion is connected to an end of the rotating portion, the stop portion is connected to a side of an end portion of the rotating portion; the rotating portion is provided with a rotating hole, a protruding cylinder is provided on the surface of the case body or the case cover, the rotating portion is sleeved on the cylinder through the rotating hole, and the stop portion is capable of being in contact with the buckle.

2. The easily lockable and unlockable handgun holster according to claim 1, wherein a groove is further provided in the surface of the case body, a clamping post is provided on a surface of the rotating portion, one end of the first spring is clamped in the groove, the other end is sleeved on the clamping post on the surface of the rotating portion, and the other end of the second spring is connected to the case cover.

3. The easily lockable and unlockable handgun holster according to claim 1, wherein a groove is further provided in the surface of the case body, a clamping post is provided on a surface of the rotating portion, one end of the first spring is clamped in the groove, the other end is sleeved on the clamping post on the surface of the rotating portion, and the other end of the second spring is connected to the surface of the case body.

4. The easily lockable and unlockable handgun holster according to claim 1, wherein a groove is further provided in the surface of the case body, one end of the first spring is clamped in the groove, the other end is connected to an inside of the rotating portion, and the other end of the second spring is connected to the case cover.

5. The easily lockable and unlockable handgun holster according to claim 1, wherein a fixing post is further provided on the surface of the case body, a clamping post is provided on a surface of the rotating portion, one end of the first spring is sleeved in the fixing post, the other end is sleeved on the clamping post on the surface of the rotating portion, and the other end of the second spring is connected to the case cover.

6. The easily lockable and unlockable handgun holster according to claim 1, wherein a groove is further provided on a surface of the case cover, one end of the first spring is clamped in the groove, the other end is connected to an inside of the rotating portion, and the other end of the second spring is connected to the case cover.

7. The easily lockable and unlockable handgun holster according to claim 1, wherein a cavity for accommodating an end portion of a handgun is provided inside the case body, a side of the case body is provided with an opening for the end portion of the handgun to enter the cavity, and the case cover and the case body are detachably fixed by a screw.

8. The easily lockable and unlockable handgun holster according to claim 1, wherein a through hole is provided in a middle of the buckle, a rotating shall penetrates the through hole, two ends of the rotating shaft are respectively rotatably fixed to an inside of the slot hole, respectively, an upper left surface of the buckle is connected to the second spring, an upper right surface of the buckle is in contact with the button, and a clamping slot for clamping a trigger guard of a handgun is provided on a lower surface of the buckle.

* * * * *